US006386397B2

(12) United States Patent
Brotspies et al.

(10) Patent No.: US 6,386,397 B2
(45) **Date of Patent: *May 14, 2002**

(54) SPRAY BOTTLE GRIP

(75) Inventors: Herbert V. Brotspies, Edison, NJ (US); John B. Cullen, Rolling Meadows, IL (US); Warren J. Smith, Kalamazoo, MI (US)

(73) Assignee: Pharmacia & Upjohn Company, Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/777,943

(22) Filed: Feb. 6, 2001

Related U.S. Application Data

(62) Division of application No. 09/375,163, filed on Aug. 16, 1999.

(60) Provisional application No. 60/097,403, filed on Aug. 21, 1998.

(51) Int. Cl.[7] ..... B65D 88/54

(52) U.S. Cl. ..... 222/321.6; 222/321.9

(58) Field of Search ..... 222/321.6, 321.9, 222/321.1, 321.8, 321.7, 372, 383.1, 385, 470, 323, 324

(56) References Cited

U.S. PATENT DOCUMENTS

| | | | | |
|---|---|---|---|---|
| 180,036 A | | 7/1876 | Jones | |
| 185,180 A | | 12/1876 | Jones | |
| 1,221,103 A | | 4/1917 | Sorensen | |
| 1,285,606 A | * | 11/1918 | Boogaard | 222/321.6 |
| 1,327,686 A | | 1/1920 | Rose | |
| 1,641,003 A | | 8/1927 | Lang | |
| 1,763,551 A | | 6/1930 | Brown | |
| 2,185,534 A | | 1/1940 | Bernhardt | 299/97 |
| 2,550,210 A | | 4/1951 | Vance, Jr. | 222/320 |
| D165,591 S | | 1/1952 | Lee | |
| 2,606,699 A | | 8/1952 | Andricks | 222/470 |
| D199,606 S | | 11/1964 | Waterman | |
| 3,225,763 A | | 12/1965 | Waterman | |
| D229,518 S | | 12/1973 | Bujan | |
| 3,820,698 A | * | 6/1974 | Franz | 222/205 |
| 4,174,055 A | | 11/1979 | Capra et al. | 222/319 |

(List continued on next page.)

FOREIGN PATENT DOCUMENTS

| | | |
|---|---|---|
| EP | 0636421 A1 | 1/1995 |
| WO | WO 9303856 | 3/1993 |
| WO | WO 9713706 | 4/1997 |

*Primary Examiner*—Henry C. Yuen
*Assistant Examiner*—Frederick C Nicolas
(74) *Attorney, Agent, or Firm*—Van Dyke, Gardner, Linn & Burkhart, LLP

(57) ABSTRACT

An ergonomically improved spray bottle grip includes a top wall surrounded by a perimeter wall that defines a first recess on the underside of the top wall. One or more shoulders projecting inwardly from the perimeter wall allow the first recess to receive a finger flange on the spray bottle in a snap fit manner. A pair of arms extend downwardly from the perimeter wall and terminate in a pair of finger grips. The finger grips may include upward portions and ribs to help prevent the user's fingers from slipping off of the finger grip. The top wall includes a closed central aperture which is dimensioned to telescopingly receive a nozzle on the spray bottle. In use, the grip is placed over the spray bottle such that the nozzle projects through the aperture. The top wall is then pressed downwardly along the spray bottle until it contacts the finger flange on the spray bottle. Thereafter, the user pushes downwardly on the finger grips while simultaneously pushing upward against the bottom of the spray bottle, such that a measured dose of the bottle contents is emitted as a spray. In another embodiment, the spray bottle grip may be integrally attached to a reciprocating member on the spray bottle.

4 Claims, 4 Drawing Sheets

U.S. PATENT DOCUMENTS 4,175,704 A 11/1979 Cohen ..... 239/320
4,602,726 A * 7/1986 Goda ..... 222/321
4,690,311 A 9/1987 Schultz ..... 222/323 X
4,896,799 A * 1/1990 Giuffredi ..... 222/321
4,944,429 A 7/1990 Bishop et al. ..... 222/153.13
4,951,840 A * 8/1990 Brison ..... 222/82
4,993,600 A * 2/1991 Tucker et al. ..... 222/321
5,092,496 A 3/1992 Gayle et al. ..... 222/386
5,127,548 A 7/1992 Brunet et al. ..... 222/80
5,135,511 A 8/1992 Houghton et al.
5,195,665 A * 3/1993 Lina ..... 222/496
5,215,227 A 6/1993 Farner ..... 222/175
5,341,993 A 8/1994 Haber et al. ..... 239/331
5,368,201 A 11/1994 Fuchs ..... 222/162
D355,491 S 2/1995 Monea
5,431,155 A 7/1995 Marelli ..... 128/200.14
5,433,343 A 7/1995 Meshberg ..... 222/309 X
5,439,177 A * 8/1995 Graf et al. ..... 239/333
5,450,983 A 9/1995 Stern et al.
5,453,093 A 9/1995 Haining
5,509,578 A 4/1996 Livingstone ..... 222/82
5,516,006 A 5/1996 Meshberg ..... 222/25
D375,788 S 11/1996 Potts et al.
5,664,711 A 9/1997 Mellon
5,792,211 A 8/1998 Teaque ..... 222/321 X
5,836,922 A 11/1998 Hansen et al.
5,893,484 A * 4/1999 Fuchs et al. ..... 222/83
5,894,963 A * 4/1999 Hirota ..... 222/321.2
D414,555 S 9/1999 Ritsche ..... D24/321 Z
D421,120 S 2/2000 Brotspies et al. ..... D24/114
D428,141 S * 7/2000 Brotspies et al. ..... D24/114
6,257,454 B1 * 7/2001 Ritshe ..... 222/153.13
6,276,568 B1 * 8/2001 Brotspies et al. ..... 222/321.6

* cited by examiner

SPRAY BOTTLE GRIP

CLAIM OF PRIORITY

This application is a divisional of commonly-assigned co-pending application Ser. 09/375,163 filed Aug. 16, 1999, which claims priority to non-provisional application Ser. No. 60/097,403 filed Aug. 21, 1998.

BACKGROUND OF THE INVENTION

This invention relates generally to spray bottles, and more particularly to a grip for use in conjunction with a spray bottle.

Spray bottles are available in a wide variety of shapes and sizes, and are used in a wide variety of applications. Some spray bottles have their contents pressurized, such as aerosol paint cans and the like, while other spray bottles have their contents expelled through a pump attached to the bottle, such as cleaning products and medicinal products. In the case of spray bottles containing liquid pharmaceutical products, it is often critical that a precise amount of the liquid pharmaceutical be dispensed each time the spray bottle is activated. Too much of the pharmaceutical product or drug may cause side effects, while too little of the drug may be ineffective. In the case of nasal spray bottles used for delivering a drug to a patient's nasal passageways, a precise amount of the drug is typically delivered by a pump mechanism that must be precisely activated. The pump is usually activated by the user placing his thumb under the bottom of the bottle, placing two of his fingers on opposite sides of a finger flange disposed towards the top end of the bottle, and then squeezing such that the bottle bottom and the finger flange are drawn toward one another. Such movement activates the pump and expels a portion of the bottle's contents.

In order to expel only a selected amount of the drug out of the bottle, the movement of the finger flange is limited by a stop positioned on the pump at a measured distance below the rest position of the finger flange. While the stop prevents spraying too large of a dose of the drug, the stop does not ensure that a complete dose is delivered. To ensure a complete dose, the finger flange must be pressed down both completely and evenly against the stop. If the finger flange is pressed down unevenly, then one side of the flange will contact the stop before the other, which may cause the user to prematurely terminate the squeezing of the finger flange and thereby deliver an incomplete dose. Similarly, if one of the user's fingers should slip, an incomplete dose may be delivered. The proper use of the pump, therefore, requires correct positioning of the fingers on the finger flange and controlled, coordinated movement of the finger flange. While these requirements may be easily met by most adults, however, people with Parkinson's disease or coordination difficulties, arthritics, stroke victims, or children all may find the proper use of a spray bottle difficult. A spray bottle that can be easily used by a wide variety of persons with varying physical conditions and of varying ages is, therefore, highly desirable.

SUMMARY OF THE INVENTION

The present invention overcomes the above described difficulties and provides an ergonomic and user-friendly device for activating spray bottles that can be more easily used by a wide variety of different people with different physical capabilities.

A grip for a bottle according to one aspect of the present invention includes a top wall defining an aperture and surrounded by a perimeter wall. At least two arms are attached to the perimeter wall and extend downwardly from the perimeter wall. At the end of each of the arms is a finger grip. In operation, the nozzle of a spray bottle is inserted through the aperture defined in the top wall until the top wall contacts the finger flange on the bottle. Thereafter, the user presses down on each of the finger grips while holding the bottom of the bottle which thereby activates the pump.

A bottle grip according to another aspect of the present invention includes a top defining a closed aperture. The closed aperture is dimensioned to telescopingly receive the nozzle on the bottle such that the top abuts the flange on the bottle. At least two arms are attached to the top and extend downwardly therefrom. Each of the arms terminates in a finger grip at an end opposite the top.

According to another embodiment of the present invention, a bottle grip includes an extension member integrally attached to a reciprocating member on the spray bottle. Relative movement of the reciprocating member with respect to the spray bottle activates a pump on the spray bottle. The grip further includes arms attached to opposite sides of the extension member and extending downwardly from the extension member toward the bottom of the bottle. A finger gripping surface is defined on each of the arms at an end opposite the extension member.

In other embodiments, the bottle grip includes an extension wall attached to the top and extending outwardly from the top in a plane generally parallel to the top. The extension wall is disposed between the arms and the top. The perimeter wall defines a first recess on its underside which includes a shoulder dimensioned to retain the finger flange on the bottle in the first recess with a snap fit. The aperture defined in the top may include a raised, annular lip surrounding the aperture. The underside of the lip defines a second recess which is dimensioned to conform to the shape of the nozzle of the bottle. The perimeter wall may also include a pair of long sides and a pair of short sides, with the extension walls extending outwardly from the long sides. Ribs or other frictional members may be defined on the finger grips to frictionally retain a user's fingers.

The bottle grip of the present invention improves the ease of use of spray bottles in several respects, especially for nasal spray bottles used for delivering predetermined doses of drugs. The finger grips provide a larger surface for gripping, and in one embodiment may be curved, thereby reducing the potential of a finger slipping. The finger grips also extend outwardly a greater distance from the pump than the finger flange, thereby making it easier for a user to press downwardly in an even fashion. Furthermore, the downwardly extending arms of the grip position the finger grips closer to the bottom of the medicine bottle, thereby enabling a person with a smaller hand to more easily use the device. The fingers are also positioned further away from the nozzle of the pump, thereby allowing a greater freedom of movement of the nozzle. These and other objects, benefits, and features of the present invention will be apparent to one skilled in the art, in light of the following specification when read in conjunction with the accompanying drawings.

DESCRIPTION OF THE PREFERRED EMBODIMENT

Figure 1:
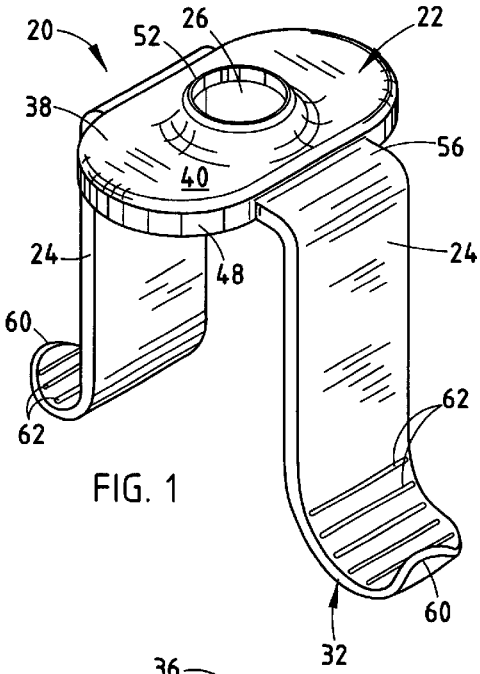
FIG. 1 is a perspective view of a grip according to one embodiment of the present invention.
Figure 2:
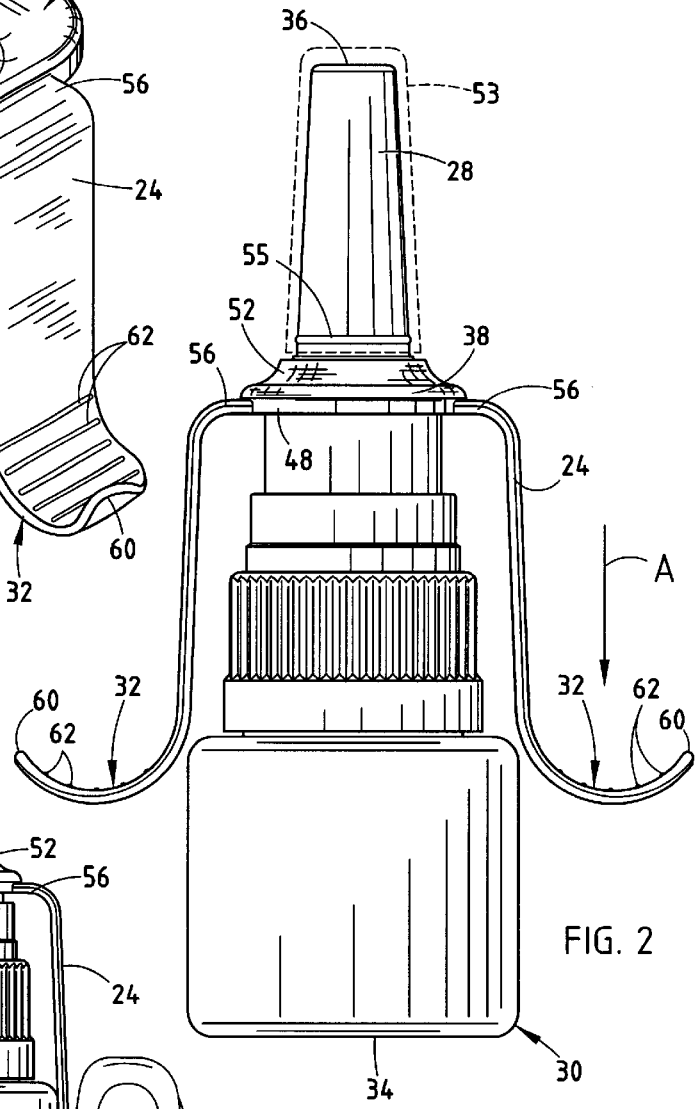
FIG. 2 is a front, elevational view of the grip of FIG. 1 shown attached to a spray bottle.
Figure 3:
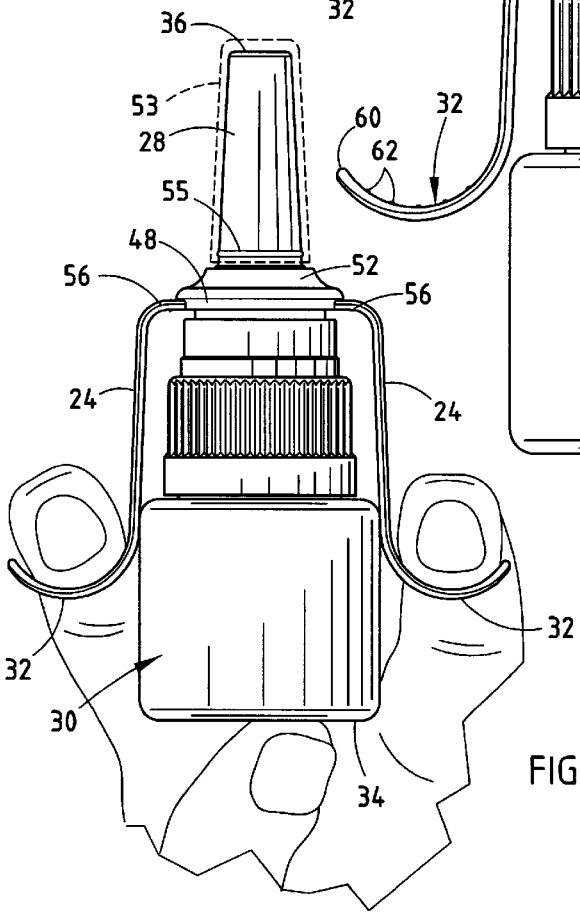
FIG. 3 is a front, elevational view of the grip shown attached to the spray bottle with the spray bottle in a compressed position.
Figure 4:
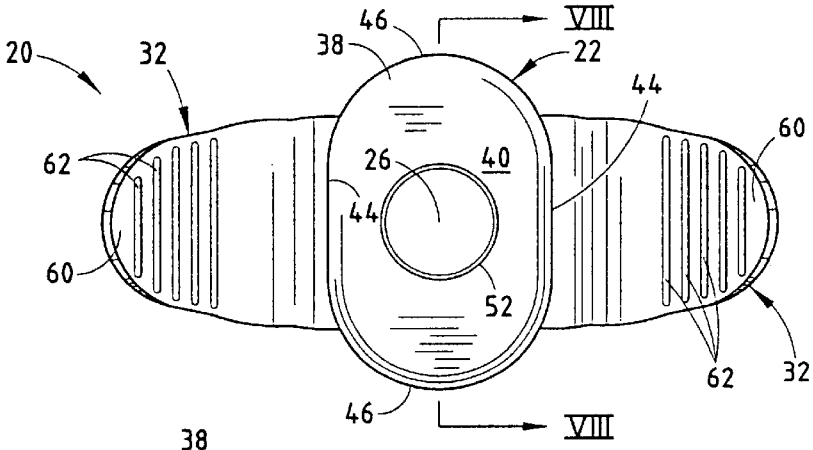
FIG. 4 is a plan view of the grip.
Figure 5:
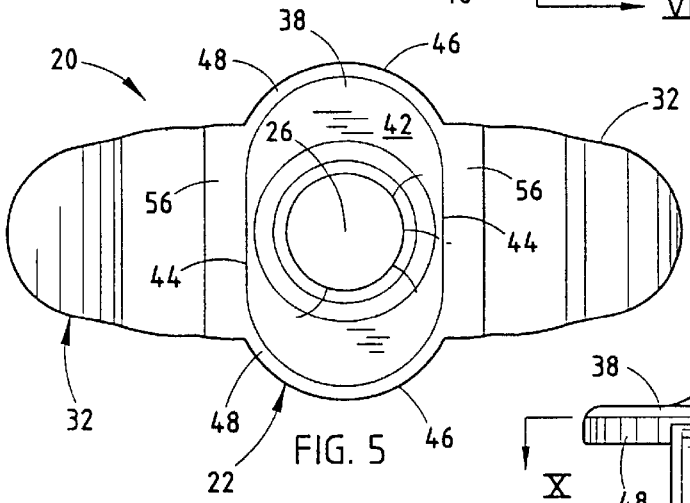
FIG. 5 is a bottom view of the grip.
Figure 6:
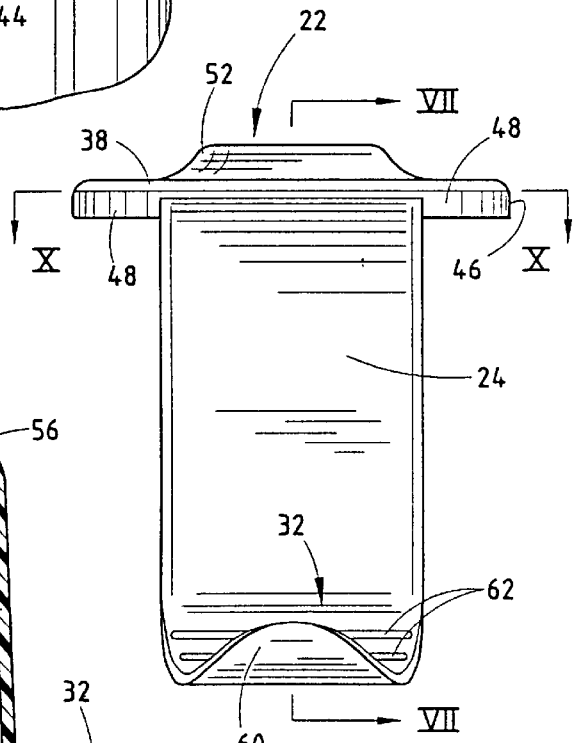
FIG. 6 is a side, elevational view of the grip.

The present invention will now be described with reference to the accompanying drawings wherein like reference numerals correspond to like elements in the several drawings. A grip 20 according to one embodiment of the present invention is depicted in FIG. 1. Grip 20 includes a top or cover 22 from which a pair of arms 24 downwardly depend. A generally circular, closed aperture 26 is defined in the center of cover 22. Aperture 26 has a diameter sufficient to telescopingly receive a nozzle 28 disposed on a spray bottle 30. A finger grip 32 is attached to each arm 24 at an end opposite cover 22. In operation, grip 20 is placed over a spray bottle 30 as shown in FIG. 2. Nozzle 28 projects through closed aperture 26, and arms 24 extend downwardly along the length of bottle 30. In order to spray the contents of bottle 30 out of nozzle 28, a user places his or her thumb on a bottom 34 of bottle 30 and two fingers on finger grips 32 (FIG. 3). Thereafter, the user exerts a downward force on finger grips 32 (see arrow A in FIG. 2) by squeezing together his or her thumb and fingers. The downward movement in grip 20 activates a pump on spray bottle 30 by moving the finger grips toward the bottom of the bottle, and thereby emits a spray from a top 36 of nozzle 28 in a precisely measured dose.

Figure 7:
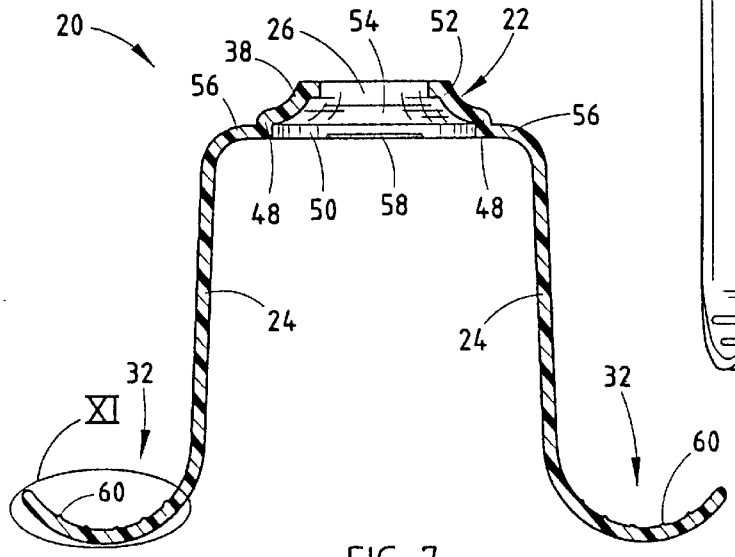
FIG. 7 is a sectional, elevational view of the grip taken along the line VII—VII in FIG. 6.
Figure 8:
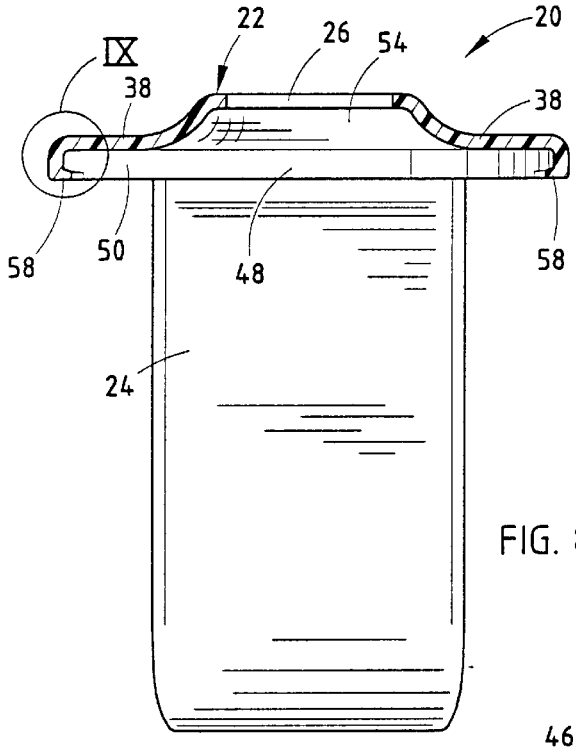
FIG. 8 is a sectional, elevational view taken along the line VIII—VIII in FIG. 4.

Cover 22 includes a generally flat top wall 38 having a top surface 40 and a bottom surface 42 (FIGS. 1–7). Bottom surface 42 contacts a finger flange on bottle 30 which is concealed from view in FIGS. 2 and 3. Top wall 38 is generally shaped the same as the shape of the finger flange of the bottle. In the disclosed embodiment, top 22 is generally oval shaped and includes a pair of long sides 44 and short or curved sides 46. A perimeter wall 48 is disposed around the edges of top wall 38 and extends downwardly from bottom surface 42. Perimeter wall 48 is oriented generally perpendicular to top wall 38. Perimeter wall 48 and top wall 38 define, in combination, a first recess 50 that is dimensioned to snugly receive the finger flange on bottle 30 (FIG. 7).

Figure 9:
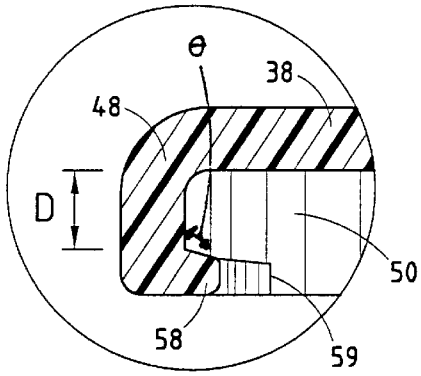
FIG. 9 is an enlarged view of the area labeled IX in FIG. 8.
Figure 10:
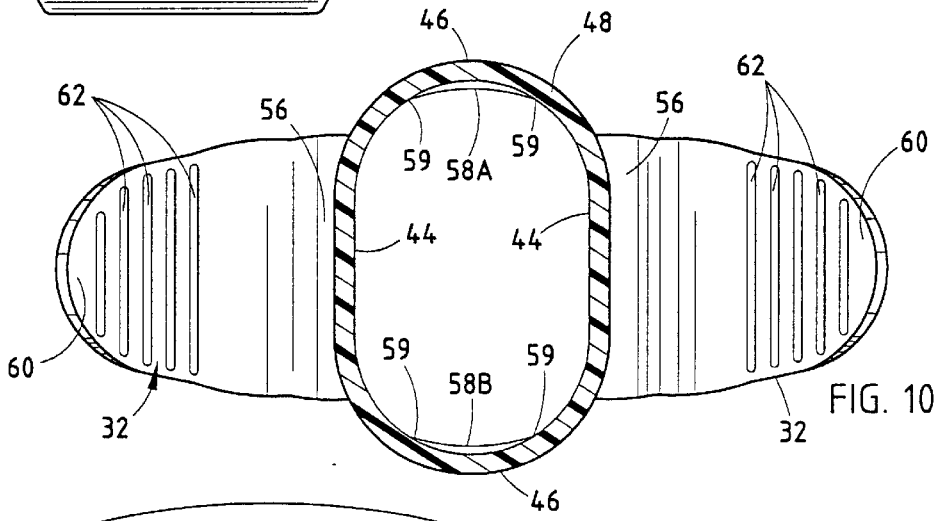
FIG. 10 is a sectional, plan view taken along the line X—X in FIG. 6.

At least one shoulder 58 is defined on perimeter wall 48 and extends inwardly toward the bottle (FIGS. 7–10). In the preferred embodiment, there are two shoulders 58*a* and 58*b*, each defined along short sides 46 of perimeter wall 48 (FIG. 10). Additional shoulders could be defined along long sides 44 of perimeter wall 48, or a continuous shoulder defined along the entire inner perimeter of perimeter wall 48 could be used. Shoulders 58 are positioned on perimeter wall 48 at a distance D below top wall 38 (FIG. 9). Distance D is slightly larger than the width of the finger flange on the bottle to allow the finger flange to fit between top wall 38 and shoulders 58. In the current embodiment, shoulders 58 extend along short sides 46 and terminate at both ends at termination points 59. The top surface of shoulder 58 slopes downwardly and defines an angle θ with the inside surface of perimeter wall 48 (FIG. 9). In the current embodiment, θ is 145°, although other angles can be used. Shoulders 58 allow grip 20 to be snap fit onto the finger flange on bottle 30. Grip 20 is made of a sufficiently flexible material to allow shoulders 58 to flex outwardly when the finger flange is inserted into first recess 50. Once the finger flange is received in first recess 50, shoulders 58 snap back to their unflexed position and releasably secure grip 20 on bottle 30. The dimensions of shoulders 58 can be varied, and are partially dependent upon the flexibility of the material used for grip 20 and the desired tightness of the resulting snap fit, as is known to one skilled in the art. In the current embodiment, both the height and width of shoulders 58 are on the order of several hundredths of an inch.

Top surface 40 of top wall 38 is generally flat except for an upwardly flared lip 52 generally surrounding the immediate circumference of aperture 26. Lip 52 extends upward from top surface 40 and defines a second recess 54 adjacent bottom surface 42. Second recess 54 is configured generally to correspond to the shape of the nozzle of the spray bottle. The positioning of the finger flange on the bottle in first recess 50 and the non-circular shape of recess 50 maintains grip 20 on the bottle and prevents rotation of grip 20 on the bottle when in use. A cap 53 (shown in phantom in FIGS. 2 & 3) may be used with bottle 30 in between administering the contents of bottle 30. Cap 53 may be held on nozzle 28 in a snap fit manner by engaging an annular ridge 55 on nozzle 28 (FIGS. 2 & 3). A plurality of shoulders (not shown) are defined on the inside, lower end of cap 53 and resiliently snap into place below ridge 55 when cap 53 is snap fit over nozzle 28. When snapped onto nozzle 28, cap 53 therefore extends a short distance below ridge 55. In the preferred embodiment of grip 20, lip 52 extends upwardly from top surface 40 a limited distance such that there is sufficient space between the top of lip 52 and ridge 55 for the shoulders or cap 53 to engage ridge 55. In other words, lip 52 should be short enough to not interfere with the operation of cap 53, thereby allowing cap 53 to be placed over bottle 30 while grip 20 is attached to bottle 30.

Figure 11:
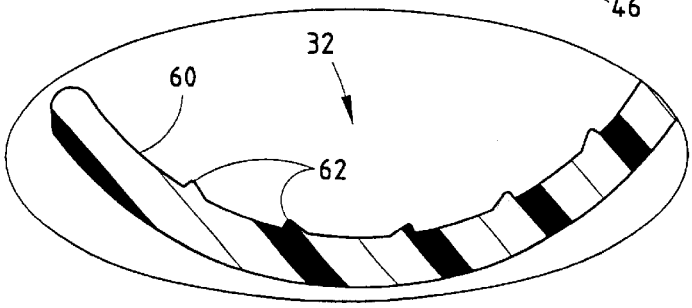
FIG. 11 is an enlarged view of the area labeled XI in FIG. 7.

An extension wall 56 is attached to each long side 44 of top 22. Extension walls 56 are oriented generally parallel to top wall 38 and in a slightly lower plane. Extension walls 56 are joined to arms 24 which extend downwardly from top wall 38. Arms 24 curl upwardly and outwardly towards their bottom end. The curled portion of arms 24 defines a finger grip or finger gripping surface 32. A plurality of ribs 62 are defined on finger grips 32 on the surface contacted by a user's fingers (FIGS. 2, 7 and 11). Ribs 62 provide increased friction to help prevent a user's fingers from sliding off of finger grips 32. It will be understood, of course, that ribs 62 could be replaced by other functional members, such as bumps, grooves, or other friction enhancing configurations. An upward portion 60 of finger grip 32 ensures that a user's fingers do not easily slip off of finger grip 32. In the preferred embodiment, finger grips 32 extend outwardly a greater extent than the finger flange on bottle 30. The greater extension of finger grips 32 makes it easier for a user to exert balanced forces when pressing downward to activate the pump on the spray bottle.

When in use, grip 20 is placed over a spray bottle 30 by telescopingly inserting the nozzle 28 of the spray bottle into closed aperture 26. Grip 20 is pushed downwardly onto spray bottle 30 until top wall 38 contacts a finger flange on the spray bottle. The finger flange of spray bottle 30 preferably snaps into first recess 50 defined on bottom surface 42 of top wall 38. The snap fit, as described above, is accomplished by one or more shoulders. The user then places two fingers on top of finger grips 32 while simultaneously placing a thumb on the bottom of spray bottle 30 (FIG. 3). Thereafter, the user squeezes down on finger grips 32 while pressing upward with his or her thumb, thereby moving the bottom of the bottle toward finger grips 32 and nozzle 28. This compression between the fingers and the thumb activates the pump on the spray bottle and thereby emits a measured dose or portion of the contents of the bottle.

In the preferred embodiment, grip 20 is made of a suitably strong plastic, preferably polypropylene. The precise type of plastic can, of course, be varied and other materials besides plastic can be used in the present invention. By way of illustrative, but not exhaustive, examples, grip 20 can be made from metal, acrylics, nylon, or other materials. In the current embodiment, Montell 6331 polypropylene manufactured by Montell Polyolefin of Pasadena, Tex., is used.

Grip 20 provides a more ergonomic device and method for using a spray bottle, especially a spray bottle which is used to deliver a preselected amount of a drug or medicine. The upward portions 60 and ribs 62 of finger grip 32 help prevent slippage of a user's fingers while activating the spray bottle. With the use of grip 20, the distance between the user's fingers and thumb is reduced, thereby making it easier for people with small hands to use. Furthermore, finger grips 32 extend outwardly a greater distance from the central vertical axis of the bottle than does the finger flange on the bottle. This greater extension of finger grips 32 makes it easier for a user to evenly compress the pump on the spray bottle.

Figure 12:
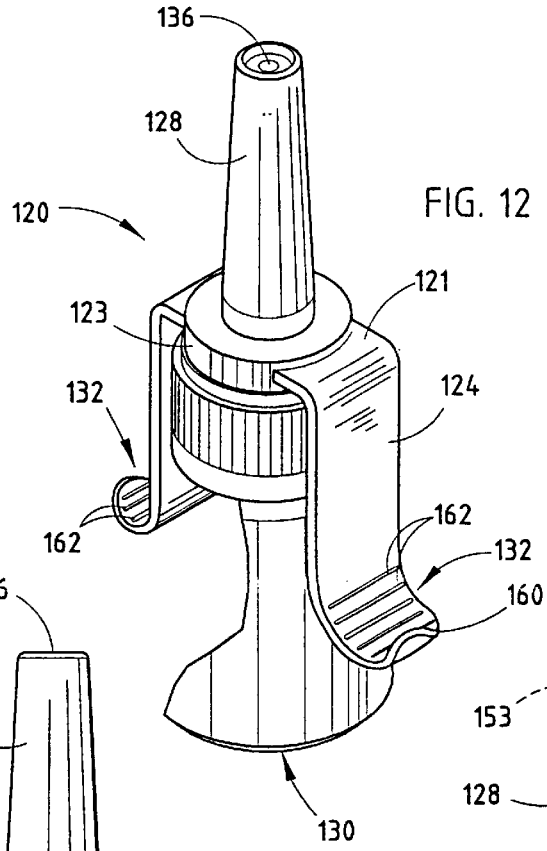
FIG. 12 is a fragmentary, perspective view of a bottle grip according a second embodiment of the present invention.
Figure 13:
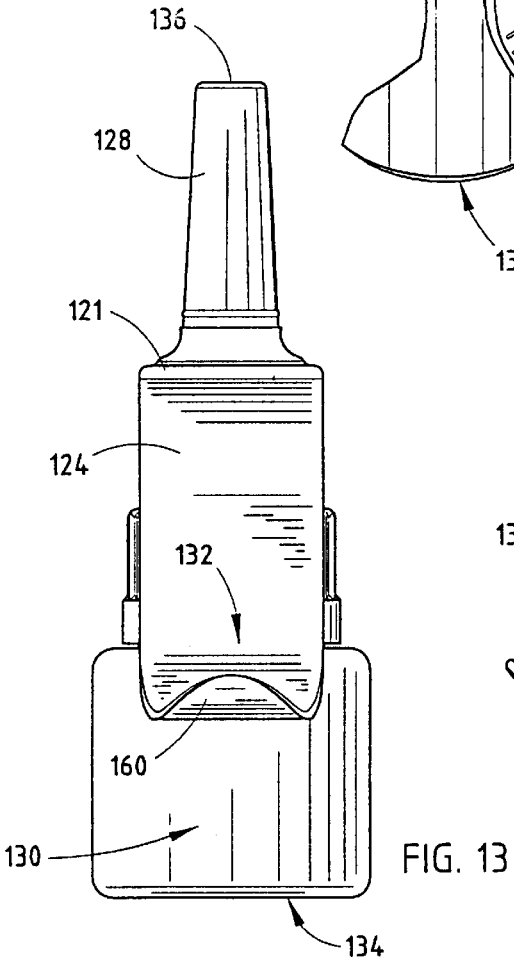
FIG. 13 is a front, elevational view of the bottle grip of FIG. 12.
Figure 14:
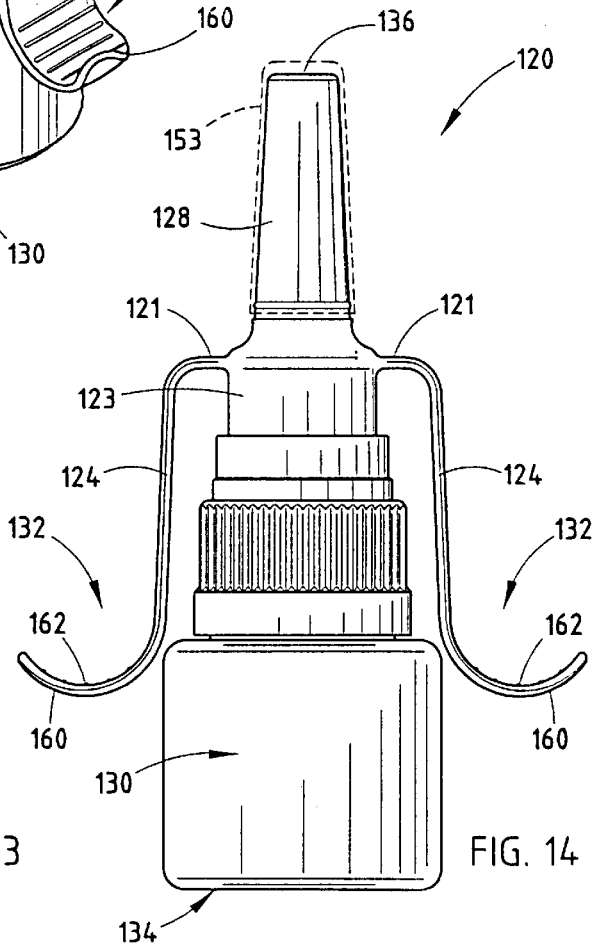
FIG. 14 is a side, elevational view of the bottle grip of FIG. 12.

A grip 120 according to a second embodiment of the present invention is depicted in FIGS. 12–14, wherein elements corresponding to like elements in grip 20 are labeled with the same numbers increased by one hundred. Grip 120 is integrally molded to bottle 130 and is not selectively detachable therefrom as is grip 20. Grip 120 includes an extension member 121 integrally attached to a reciprocating member 123 on bottle 130. Relative movement of reciprocating member 123 with respect to bottle 130 activates the pump on the bottle, thereby expelling a portion of the contents of the bottle. Extension member 121 is located on bottle 130 generally in the same position as the finger flange on bottle 30. A pair of arms 124 extend downwardly from extension member 121 along opposite sides of extension member 121. A finger gripping surface 132 is defined on each of arms 124. Finger grips 132 are defined on the ends of arms 124 and spaced from extension member 121. Finger grips 132 may include a plurality of ribs 162, or other frictional members, for providing increased frictional resistance to slipping of a user's fingers. Grip 120 is preferably manufactured from the same material as reciprocating member 123 on bottle 130, such as polypropylene, although other materials may be used. Currently, reciprocating member 123 on bottle 130 is manufactured from one of two polypropylene blends: (1) 99.5% Hoechst PPV 1780 Natural polypropylene and 0.5% Ferro White FA 5089L coloring agent available from Hoechst AG of Germany, and Ferro Corporation of Cleveland, Ohio, respectively; or (2) 75% Hostalen PPT 1070 S1 (M) Natural polypropylene and 25% Hostalen PPR 1060 F (M) White 24 coloring agent, available from Hostalen GmbH of Germany. As noted, other types of materials could be used, including, but not limited to, nylon, acrylics, metal, or other types of plastics. Grip 130 operates in the same fashion as grip 20; namely, by pressing downward on finger gripping surfaces 132 while pushing the bottle upward, the spray bottle is activated. Grip 120 provides similar benefits and results as grip 20.

It will be understood that various modifications can be made to either embodiment of the present invention. For example, extension walls 56 could extend outward a greater distance such that finger grips 32 would extend inwardly, rather than outwardly. Finger grips 32 could also be modified to form a complete loop through which a user's fingers would be inserted. Arms 24 and extension wall 56 could also be modified to extend out of short sides 46 on top 22 instead of long sides 44. With arms 24 and extension wall 56 extending out of short sides 46 on top 22, aperture 26 could be additionally modified to be partially open along one of long sides 44, thereby allowing grip 20 to be moved sideways over the bottle rather than over the tip of the nozzle. As yet another possible modification, arms 24 could be joined to each other forming a cylindrical housing that partially fits over the bottle. The foregoing modifications may be made to grip 20, grip 120, or both.

While the present invention has been described in terms of the preferred embodiments discussed in the above specification along with various modifications, it will be understood by one skilled in the art that the present invention is not limited to these particular preferred embodiments and variations, but includes any and all such modifications that are within the spirt and scope of the present invention as defined in the appended claims.

The embodiments of the present invention in which an exclusive property or privilege is claimed are defined as follows:

1. In a spray bottle having a pump that includes a reciprocating member wherein relative movement between the reciprocating member and the bottle causes the pump to expel at least a portion of the contents of the bottle, a grip comprising:

an extension member integrally connected to the reciprocating member, said extension member extending outwardly from the bottle in opposite directions and having opposite sides;

a pair of spaced arms attached to opposite sides of said extension member, each said arm extending downwardly from said extension member and toward a bottom of the spray bottle from its respective side; and a finger gripping surface defined on each said arm at an end of said arm spaced from said extension member.

2. The grip of claim 1 wherein said finger gripping surface further includes a plurality of frictional members defined thereon, said frictional members adapted to help frictionally retain a user's fingers on said finger gripping surfaces.

3. The grip of claim 1 wherein said finger gripping surface is curved concavely upwardly.

4. The grip of claim 2 wherein said frictional members defined on said finger gripping surfaces are ribs.

* * * * *